United States Patent [19]

Gebelius

[11] Patent Number: 4,515,241

[45] Date of Patent: May 7, 1985

[54] FLAG-POLE

[76] Inventor: Sven R. V. Gebelius, Drottningholmsväg 195, Bromma, Sweden, S-161 36

[21] Appl. No.: 591,897

[22] Filed: Mar. 21, 1984

Related U.S. Application Data

[63] Continuation of Ser. No. 355,562, Feb. 17, 1982.

[30] Foreign Application Priority Data

Jun. 23, 1980 [SE] Sweden ..... 8004633
Sep. 1, 1980 [SE] Sweden ..... 8006099

[51] Int. Cl.[3] ..... E06C 1/38; E04H 12/32

[52] U.S. Cl. ..... 182/96; 182/97; 182/99; 182/100; 182/189

[58] Field of Search ..... 182/100, 91, 96, 159, 182/189, 160, 97, 98, 99; 52/116, 117

[56] References Cited

U.S. PATENT DOCUMENTS

| | | | |
|---|---|---|---|
| 426,267 | 4/1890 | Greenlow | 182/145 |
| 438,036 | 10/1890 | Verstraete | 182/189 |
| 627,893 | 6/1899 | Becker | 182/189 |
| 829,336 | 8/1906 | Haycock | 182/189 |
| 1,439,030 | 12/1922 | Stahl | 182/96 |
| 2,271,609 | 2/1942 | Hall | 52/116 |
| 2,822,066 | 2/1958 | Hanson | 52/117 |
| 2,875,865 | 3/1959 | Rohn | 52/116 |
| 4,258,828 | 3/1981 | Evans | 182/100 |

*Primary Examiner*—Reinaldo P. Machado
*Attorney, Agent, or Firm*—Holman & Stern

[57] ABSTRACT

A flag-pole (1), tiltable in direction towards an adjacent house or building, and at the lower portion (1') being provided with a device (6) facilitating climbing or transport of persons to the outer edge portion of the roof surface (2) of the house or building. At least the top portion (1'') of the flag-pole is tiltable in relation to a vertical plane, thereby extending in a parallel relationship to the roof surface (2), but at a distance therefrom. Alternatively, both the lower portion (1') and the top portion (1'') may be tiltable in the same direction, the top portion (1'') thereby taking up the above described position, whereas the lower portion (1') takes up a less inclined position, intended to move the upper part of the lower portion (1') adjacent to the outer edge portion of the roof surface (2). The lower portion (1') of the flag-pole is preferably arranged with a longitudinally extending groove or channel, housing a step or ladder device (6), which can be swung out from the groove or channel, thus facilitating climbing between the ground surface and the lower edge portion of the roof.

8 Claims, 5 Drawing Figures

Fig. 3
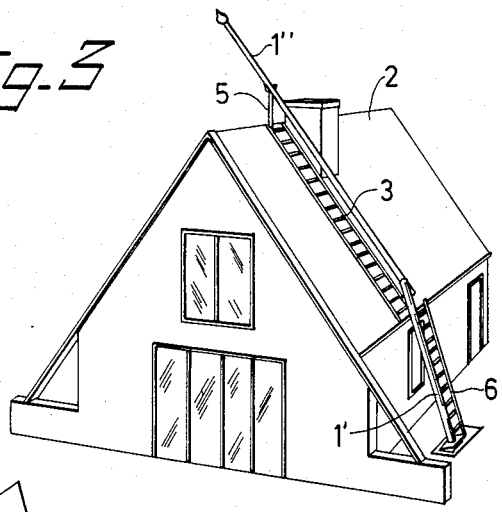
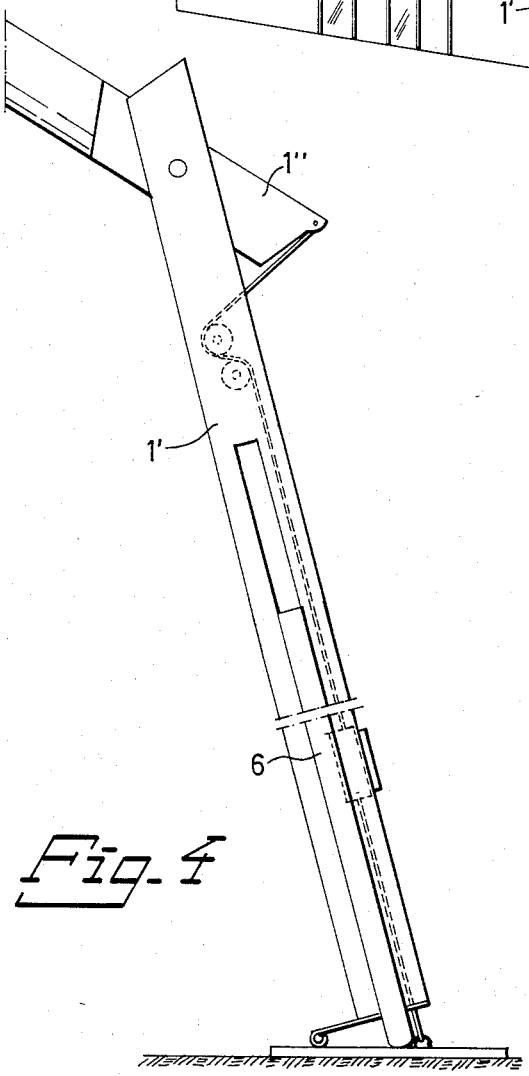
Fig. 4
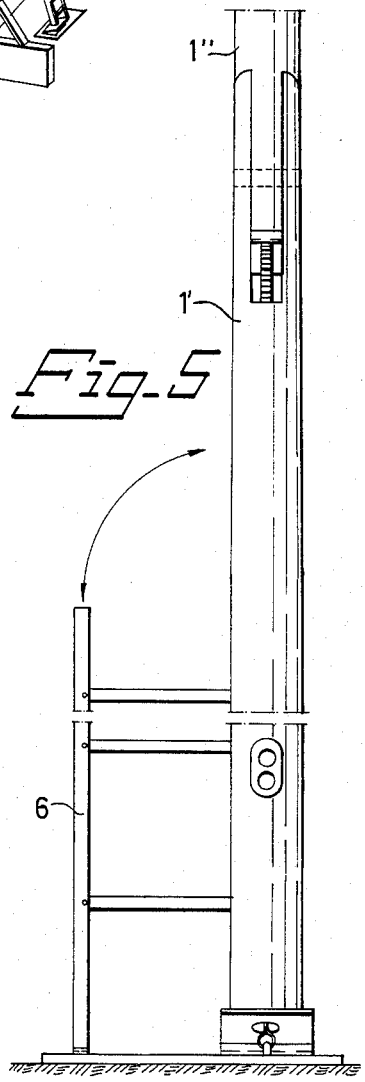
Fig. 5

FLAG-POLE

This is a continuation of application Ser. No. 355,562 filed 2/17/82.

CROSS REFERENCE TO RELATED APPLICATION

The invention of this application is disclosed in corresponding International Application No. PCT/SE18/00184 filed June 18, 1981, the benefit of which is being claimed.

BACKGROUND OF THE INVENTION

1. Field of The Invention

The present invention relates to a flag-pole, intended to be located adjacent to a house or a building.

2. Description of the Prior Art

There is a need for ladders or similar structures, both with regard to smaller houses and industrial buildings, to enable chimney-sweepers and other authorised persons to ascend the roof. From the edge of the roof, climbing may be possible either by a ladder attached to the roof, or by steps attached against the roof surface. However, it is both dangerous and difficult to pass the edge of the roof, particularly when climbing down towards the ground surface, when moving from the steps or the ladder arranged by the roof surface to a ladder, positioned inclined towards the wall surface. It is particularly difficult when carrying large tools or other objects, e.g, when a chimney-sweeper is climbing down from a roof with his sweeping tools.

BRIEF SUMMARY OF THE INVENTION

The object of the present invention is to disclose a previously unknown combination of a flagpole and a climbing device, which faciliates fast and simple movement in direction from and towards the ground plane. This feature is combined with a flag-pole, i.e. an object which is most desirable for many persons, but which may not be realized, mainly due to the costs involved for same. By arranging the climbing device as a combination with a flag-pole, two desired objects are achieved, i.e. the necessary ladder or climbing device required for chimney-sweepers and others to ascend the roof, but also a flag-pole, usually desired for personal and aesthetic reasons. The flag-pole according to the present invention can also in many cases be used as a fire-escape, and thus simplify departure from a house in case of fire, and when used in this respect, it is a far more desirable solution than conventional types of fixed fire-escapes, particularly from an aesthetic of view.

The flag-pole according to the present invention includes as a main characteristic feature a number of steps, pivotably attached to the flag-pole, which in a first position are located surrounded by the flagpole, and in a second position extend outwardly from the flag-pole, preferably mainly transversely in relation to the length axis of the flag-pole, said steps preferably only being arranged at the portion of the flag-pole located adjacent to the ground plane. The upper portion of the flag-pole is preferably pivotably arranged in relation to the lower portion, and thus tiltable to a position in which the upper part of the flag-pole extends over the roof surface of an adjacent house or building, having an inclination preferably mainly corresponding to the inclination of the roof surface in relation to the ground plane.

However, the flag-pole according to the present invention is not restricted only to the above characteristic features, since further features are discussed below with reference to a number of embodiments within the scope of the invention.

BRIEF DESCRIPTION OF THE DRAWINGS

A number of embodiments of a flag-pole according to the invention will now be discussed, one embodiment being particularly described with reference to the accompanying drawings wherein;

FIG. 3 is a partial view corresponding to FIG. 1, with the flag-pole in position to use as a means for climbing the roof of the house, FIG. 4 is a side elevational view of the lower portion of the flag-pole, shown in an enlarged scale and with climbing steps extending from same, and FIG. 5 is an elevational view of the embodiment as shown in FIG. 4.

DETAILED DESCRIPTION

Before discussing the embodiment illustrated, a number of basic features and requirements related to the use of a flag-pole according to the present invention should be mentioned. Firstly, the flag-pole must be located adjacent to the house or the building, in order to faciliate movement between the lower portion of the flag-pole and the roof. The lower portion of the flag-pole, used to facilitate transport between the ground plane and the edge of the roof, does not necessarily include steps, intended to facilitate climbing, but also other means faciliating transport of a person from the ground plande to the region adjacent to the outer edge portion of a roof. Said climbing steps, or any other means used for transport, is arranged to take up a position, when not used, which leaves the lower portion of the flag-pole unobstructed, thus facilitating use of the flag-pole as a conventional flag-pole.

The embodiment shown in FIGS. 1–5 discloses a number of features, but all of these features need not necessarily be included, as discussed later.

Figure 1:
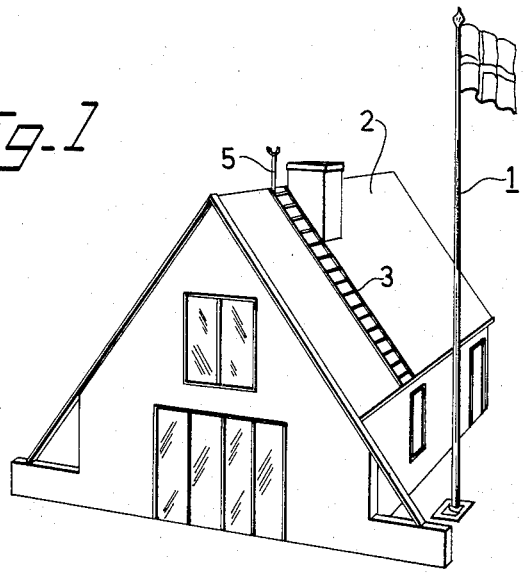
FIG. 1 is a perspective view of a house, having a flag-pole according to the present invention arranged located adjacently to one side of the house.

With reference to FIG. 1, a flag-pole, as a complete structure denominated 1, is shown located near a house, having an inclined roof surface 2, on which surface 2 a ladder 3 is permanently attached in a previously known way. With reference to the outer edge portion of the roof surface 2, the flag-pole 1 is located only a few meters from same, and with regard to the ladder 3, the flag-pole 1 is located adjacent to one side portion of same. When the flag-pole 1 is in the position as shown in FIG. 1, it may be used as a conventional flag-pole 1, and there is no aesthetically disturbing elements extending from same.

Figure 2:
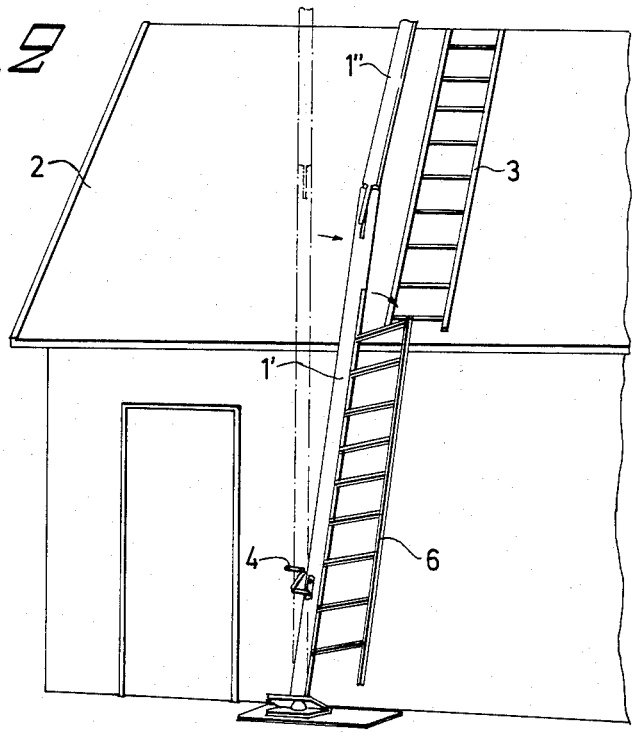
FIG. 2 is a perspective partial side view, showing the lower portion of the flag-pole shown in FIG. 1, when prepared for use as a means for climbing the roof of the house.

When the flag-pole 1 is to be used as a means for ascending the roof surface 2, a cranking handle 4 is inserted into the lower portion of the flagpole 1, said lower portion being denominated 1'. The lower portion 1', which is a tubular member and surrounds a winch, a gear reduction transmission or similar means, which can be operated by means of the cranking handle 4. The winch or gear transmission is arranged connected to the base of the flag-pole 1 and also to the upper point of the lower portion 1' of the flag-pole. An upper portion of the flag-pole 1, denominated 1'', is pivotably attached to the upper point of the lower portion 1', and when the cranking handle 4 is turned, the lower portion of the flag-pole 1' is slightly tilted in direction towards the outer edge portion of the roof surface 2, and at the same time the upper portion 1'' is also tilted to an angle in relation to the ground plane mainly corresponding to the angle of the roof surface 2 in relation to the ground plane. A support member 5 extends vertically from the ridge of the roof, and the upper portion 1'' is lowered until it rests on the support member 5. When the flag-pole 1 has been tilted as described, a number of steps, pivotably attached to a groove or channel in the lower portion 1' of the flag-pole, joined together by a longitudinally extending member at the outer end portions, thus forming a ladder 6, is swung out from the flag-pole 1, as shown in FIG. 2. Said longitudinally extending member is obviously also pivotably attached to the outer end portions of the steps, in order to facilate the described movement.

In order to hold the ladder 6 in a position surrounded by the flag-pole 1, when not used, a locking mechanism is arranged, which can be manually released, and thus facilitate the movement in direction from the surrounding groove or channel. Furthermore, abutment means are also arranged, which hold the steps of the ladder 6 in a position extending mainly perpendicularly from the length axis of the lower portion 1' of the flag-pole, when the ladder 6 is swung out.

When said operations have been carried out, the flag-pole 1 extends as shown in FIG. 3, i.e. the lower portion 1' is slightly tilted towards the outer edge portion of the roof surface 2, and the upper portion 1'' extends at an angle mainly corresponding to the inclination of the roof surface 2 in a mainly parallel relationship to same, but located at a distance from the roof surface 2. The ladder 6, formed by means of the lower portion 1' of the flag-pole and the steps with interconnecting longitudinally member, extends from the ground plane to the outer edge portion of the roof surface, thus forming an extension to the fixed ladder 3 attached against the roof surface.

When entering onto the roof of the house, the ladder 6 swung out from the flag-pole 1 is entered used in a conventional manner, and when reaching the outer edge portion of the roof surface, the upper portion 1'' of the flag-pole is used as a handle bar, when moving from the first ladder 6 to the ladder 3 attached against the roof surface. The upper portion 1'' of the flag-pole, used as a handle bar, makes it extremely simple to move from the first ladder 6 to the second ladder 3, and it is also possible to climb the second ladder 3 in an upright position. Leaving the roof is equally simple, since the person leaving the roof can walk in an upright position along the fixed ladder 3, and passing the outer edge portion of the roof surface 2 is extremely simplified, since the upper portion 1'' of the flag-pole is used as a handle bar, when moving from the fixed ladder 3 to the ladder 6 formed by the lower portion 1' of the flag-pole.

After use, the ladder 6 formed by the lower portion 1' of the flag-pole is swung back into the groove or the channel in said portion 1', and a previously mentioned locking mechanism secures same surrounded by the lower portion 1' of the flag-pole. The longitudinally extending member, which joins each step, will now be located outside the steps and closes the groove or the channel, the outside surface preferably arranged to join the outer peripheral surface of the lower portion 1' of the flag-pole. By turning the cranking handle 4, the lower 1' and the upper portion 1'' of the flag-pole is tilted back into upright position, i.e. as shown in FIG. 1, and when the cranking handle 4 has been removed, the flag-pole 1 can be used as a conventional flag-pole again.

FIGS. 4 and 5 show in an enlarged scale how the flag-pole 1 as disclosed above is arranged, but these figures are only intended to indicate how the winch or gear reduction transmission, operated by the cranking handle 4, may be interconnected to achieve the described tilting action.

The embodiment shown and described may be modified in a number of ways, whilst maintaining many of the advantages achieved with a flag-pole 1 as described and shown. Accordingly, the lower portion 1' of the flag-pole may be rigidly attached to the ground plane, i.e. with only the upper portion 1'' tiltable when the cranking handle 4 is inserted and operated. Such a modification simplifies the design of the flag-pole 1, but as a result, the lower portion 1' must be located more closely adjacent to the outer edge portion of the roof surface 2, to faciliate movement from the first ladder 6 to the ladder or steps 3 attached against the roof surface 2.

Alternatively, the flag-pole 1 may also be arranged as one unit only, i.e. without an upper 1'' and a lower portion 1', pivotably joined to each other. In this case, the entire length of the flag-pole 1 is tilted towards the outer edge portion of the roof surface 2, the lower part of the flag-pole 1 being arranged with steps forming a ladder 6, thus faciliating climbing to the roof surface 2. The remaining length of the flag-pole 1 can still be used as a support means when entering or leaving the roof surface 2, but this modification would obviously remove one inportant feature, i.e. there would be no handle bar which assists movement along the ladder 3 attached against the roof surface 2.

Furthermore, the longitudinal member joining the outer end portions of each step in the ladder 6, formed in conjunction with the lower portion 1', may also be excluded, in which case either each step may be individually swung in direction from and to the flag-pole 1, or the steps may be joined by an interconnecting member surrounded by the flag-pole 1 adjacent to the end portions pivotably attached to the flag-pole 1, thus faciliating simultaneous movement of all steps.

The means for entering the lower portion 1' of the flag-pole may be further altered, particularly when the flag-pole 1 is extremely long, i.e. located nearby a multistorey building, and intended to faciliate access to the roof of same. The means forming a ladder 6 in the previously discussed embodiments could in this case be arranged as cogs or teeth, located in a groove or a channel in the flag-pole 1, arranged to interconnect with a cogwheel or similar device driven by a motor, forming part of a platform which can be elevated along the flag-pole 1. Such a platform would, when not in use, be located at the ground plane, and when the motor is operated, e.g. an electric motor, the platform would move up along the flag-pole 1. Said flag-pole may, as previously discussed, either by arranged as two separate parts 1', 1', arranged to take up tilted positions inclined towards the roof, or with only the upper portion 1'' tilted, or with the entire flag-pole 1 as a unit tilted towards the roof of an adjacent house or building.

If desired, the platform may also be arranged with a surrounding hand rail, which when not in use is folded down, located adjacent to the surface of the platform.

Accordingly, the present invention is in no way restricted to the embodiment shown and described, since many modifications apparently are possible within the scope of the invention and the following claims, and as discssed with reference to possible modifications of the embodiment shown.

Possible modifications also include the use of independent means for climbing to the roof, which means are attachable against the lower portion 1' of the flag-pole. Such means may comprise individual steps, attachable to the flag-pole 1, e.g. by insertion through holes extending transversely and spaced apart in the length direction of the flag-pole 1, or by means of a ladder or similar structure, attachable to attachment means located by the lower portion 1' of the flag-pole 1.

I claim:

1. A flag-pole comprising:

an elongated tubular lower portion extending from the ground;

first pivot means to pivotably attach said lower portion adjacent to the ground plane so that said lower portion is tiltable from a substantially vertical first position to a second inclined position toward an adjacent building where the upper end of said lower portion is adjacent the outer edge of a roof surface of the building;

an elongated upper portion;

second pivot means to pivotably attach said lower and upper portions together adjacent their upper and lower ends, respectively, so that said upper portion is tiltable about said second pivot means from a first position substantially aligned with said lower portion to a second inclined position at an angle to said lower portion extending in a direction substantially parallel to the roof of the building, said upper portion in said second inclined position functioning as a handrail for persons walking on the roof;

support means on the roof operatively engageable with said upper portion when in said second inclined position to support said upper portion during use as a handrail; and means cooperatively associated with said lower portion to facilitate elevating a person along said lower portion from the ground to the roof.

2. A flag-pole as claimed in claim 1 wherein said support means comprises:

a rod member extending upwardly from said roof releasably engageable at its upper end with said upper portion to brace said upper portion and hold it in said second inclined position substantially parallel to the roof.

3. A flag-pole as claimed in claim 1 and further comprising:

a power transmission means housed in said lower portion and cooperatively associated with said lower and upper portions to operate them between said first positions and said inclined positions.

4. A flag-pole as claimed in claim 1 further comprising:

a channel in said lower portion extending longitudinally with respect thereto; and wherein said elevating means is a ladder comprising a plurality of spaced step mebers each pivotably attached at one end portion in said channel so that when not in use they are housed within said lower portion and in use are pivotable to a position extending substantially perpendicular to the longitudinal axis of said lower portion.

5. A flag-pole as claimed in claim 4 and further comprising: an elongated member extending substantially parallel to the longitudinal axis of said lower portion and pivotably connected to the free end portions of said step members to facilitate simultaneous pivotal movement of said step members between the used and unused positions thereof, said steps, lower portion and elongated member forming a ladder in the position for use, and said elongated member having a shape to serve as a protective cover for said channel when said step members are in the unused position.

6. A flag-pole as claimed in claim 1 wherein said elevating means comprises a platform mounted on said lower portion to move therealong when said lower portion is in said inclined position, a gear mechanism operatively associated with said lower portion and said platform to move said platform when operated, and a drive motor mounted on said platform and operatively connected to said gear mechanism to move said platform when activated, said platform being positioned adjacent to the ground surface when not in use.

7. A flag-pole as claimed in claim 4 and further comprising a locking mechanism, arranged to secure the steps when housed in said lower portion.

8. A flag-pole as claimed in claim 3 and further comprising means in the lower portion of the flag-pole adapted to facilitate attachment of individual and separate steps forming a ladder.

* * * * *